US009093784B2

(12) United States Patent
Zhang

(10) Patent No.: US 9,093,784 B2
(45) Date of Patent: Jul. 28, 2015

(54) CONNECTOR WITH LOCKING STRUCTURE

(71) Applicant: Molex Incorporated, Lisle, IL (US)

(72) Inventor: Xue-Hai Zhang, Kunshan (CN)

(73) Assignee: Molex Incorporated, Lisle, IL (US)

( * ) Notice: Subject to any disclaimer, the term of this patent is extended or adjusted under 35 U.S.C. 154(b) by 22 days.

(21) Appl. No.: 14/098,214

(22) Filed: Dec. 5, 2013

(65) Prior Publication Data

US 2014/0227898 A1 Aug. 14, 2014

(30) Foreign Application Priority Data

Dec. 10, 2012 (CN) ..... 2012 2 0678366

(51) Int. Cl.

| | |
|---|---|
| ***H01R 13/625*** | (2006.01) |
| ***H01R 4/50*** | (2006.01) |
| ***H01R 13/627*** | (2006.01) |
| ***H01R 13/6582*** | (2011.01) |
| *H01R 12/72* | (2011.01) |

(52) U.S. Cl.

CPC ..... *H01R 13/6272* (2013.01); *H01R 13/6582* (2013.01); *H01R 12/724* (2013.01)

(58) Field of Classification Search

CPC ..... H01R 13/627; H01R 13/6582; H01R 13/6272; H01R 12/724

USPC ..... 439/345, 660, 607.01, 607.35, 607.36, 439/607.4

See application file for complete search history.

(56) References Cited

U.S. PATENT DOCUMENTS

| | | | | |
|---|---|---|---|---|
| 8,038,480 | B2 * | 10/2011 | Wei | 439/660 |
| 8,157,599 | B2 * | 4/2012 | Wei | 439/660 |
| 2010/0210139 | A1 * | 8/2010 | Wei | 439/607.01 |
| 2012/0015560 | A1 * | 1/2012 | Wei | 439/626 |
| 2013/0040501 | A1 | 2/2013 | Peng | |

FOREIGN PATENT DOCUMENTS

| | | | |
|---|---|---|---|
| CN | 2924840 | Y | 7/2007 |
| CN | 201315359 | Y | 9/2009 |
| CN | 200920001857.X | * | 12/2009 |
| CN | 201387960 | Y | 1/2010 |

OTHER PUBLICATIONS

Machine Translation of CN 2009 2000 1857.X, Jan. 26, 2015.*

* cited by examiner

*Primary Examiner* — Javaid Nasri
(74) *Attorney, Agent, or Firm* — Stephen L. Sheldon

(57) ABSTRACT

An receptacle comprises a body, a plurality of terminals and a cage; a front end of the cage is formed with a mating cavity provided around a tongue and a receiving cavity positioned above and communicated to the mating cavity, and a transverse width of the receiving cavity is smaller than a transverse width of the mating cavity, the cage comprises a top plate, the top plate is provided with a receiving groove which is opened at a front end thereof, the top plate is bent rearwardly and extend to form bent portions from both sides of the receiving groove, respectively, the two bent portions extend rearwardly to from a locking portion, the locking portion is used for engaging the hook of the plug, the receiving cavity is formed between the locking portion and the top plate.

10 Claims, 11 Drawing Sheets

CONNECTOR WITH LOCKING STRUCTURE

RELATED APPLICATIONS

This application claims priority to Chinese Application No. 201220678366.0, filed Dec. 10, 2012, which is incorporated herein by reference in its entirety.

TECHNICAL FIELD

The present disclosure relates to a receptacle, and particularly relates to a receptacle which is not easily disengaged with an plug accidentally.

BACKGROUND ART

Chinese patent application CN200920001857.X discloses an receptacle, which comprises: an body, a rear part of which is formed with an accommodating cavity, and a front part of which protrudes forwardly to form a tongue; a plurality of terminals which comprise an upper row of terminals and a lower row of terminals respectively mounted to an upper side and a lower side of the tongue, each terminal has a mating portion, a soldering portion, and a bent portion connected between the mating portion and the soldering portion, the mating portions of the up row of terminals and the mating portions of the lower row of terminals are mounted to the upper side and the lower side of the tongue, respectively, the soldering portions of each row of terminals extend out from an underside of the rear part of the body and are arranged as two rows (i.e. a front row and a rear row); an outer cage which is mounted to an outer periphery of the body; and two positioning modules which are mounted in the accommodating cavity of the body and cover outer peripheries of the bent portions of the plurality of terminals, which can effectively prevent the bent portions of the terminals from being bent and contacting with each other to cause a short circuit failure when subjected to an external force.

When this receptacle in the prior art is mated with another mating electrical connector, an engagement is maintained by that a plurality of leaf springs extending inwardly from the outer cage of this receptacle latch on an outer cage of the mating electrical connector. An engagement force between these two electrical connectors is limited, accidental disengagement easily occurs in a large vibration environment (such as an automobile or motion machinery). Therefore, it is necessary to improve the engagement structure of the electrical connector in the prior art.

SUMMARY OF THE INVENTION

A receptacle is disclosed which can correspondingly mate with a plug having a hook, the receptacle comprising: a body which comprises a base portion and a tongue protruding forwardly from the base portion; a plurality of terminals, each terminal has a mating portion and a soldering portion, the mating portions of these terminals are respectively provided at an upper side and a lower side of the tongue; and a cage which is mounted to an outer periphery of the body, a front end of the cage is formed with a mating cavity provided around the tongue and a receiving cavity positioned above and communicated to the mating cavity, and a transverse width of the receiving cavity is smaller than a transverse width of the mating cavity, the cage at least comprises a top plate, the top plate is provided with a receiving groove which is opened at a front end thereof, the top plate is further bent rearwardly and extends to form two bent portions respectively at front edges of both sides of the receiving groove; the two bent portions further extend rearwardly to form a locking portion, the locking portion is capable of correspondingly engaging the hook of the plug, the receiving cavity is formed between the locking portion and the top plate.

The locking portion connects rear ends of the two bent portions together, a middle part of the locking portion is formed with a latching hole penetrating up and down. The locking portion is suspended above the receiving groove, the receiving cavity is formed between the locking portion and the receiving groove, a transverse width of the receiving groove is the transverse width of the receiving cavity, the transverse width of the receiving cavity is smaller than the transverse width of the mating cavity.

The cage further comprises a bottom plate and two side plates connected between the top plate and the bottom plate, the top plate, the bottom plate and the two side plates are enclosed to form the mating cavity. The cage further comprises a bottom plate, two side plates connected between the top plate and the bottom plate and a rear cover bending downwardly from a rear end of the top plate and extending; a front end surface of the body is formed with a slot, a rear end of the bottom plate can be correspondingly inserted into the slot. The body comprises a main body, and a first module and a second module which are mounted on the main body, the main body comprises the base portion and the tongue, the main body further comprises an accommodating cavity provided behind the base portion, the first module and the second module are stacked up-down and received in the accommodating cavity. An upper side and a lower side of the tongue are respectively provided with a plurality of terminal grooves; these terminals are respectively embedded into the first module and the second module, the mating portions of these terminals are correspondingly inserted at the upper side and the lower side of the tongue.

In an embodiment at least one positioning protruding post protrudes from the first module, at least one positioning groove is recessed on the second module, the at least one positioning groove and the at least one positioning protruding post are engaged correspondingly, so that the first module and the second module are aligned and mounted together.

In an embodiment the main body further comprises a frame body portion extending rearwardly out from the base portion, the frame body portion comprises a top wall extending rearwardly out from a top of the base portion, two side walls extending rearwardly out from both sides of the base portion and a bottom wall extending rearwardly out from a bottom of the base portion, a positioning post protrudes downwardly from the bottom wall.

In an embodiment the plurality of terminals comprise two current terminals and a plurality of differential signal terminals, and the mating portions of these two current terminals are provided oppositely up and down respectively at the upper side and lower side of he tongue wall, and transverse widths of the mating portions of these two current terminals are greater than transverse widths of the mating portions of these differential signal terminals.

BRIEF DESCRIPTION OF THE DRAWINGS

The present invention is illustrated by way of example and not limited in the accompanying figures in which like reference numerals indicate similar elements and in which.

DETAILED DESCRIPTION OF THE PREFERRED EMBODIMENTS

Figure 1:
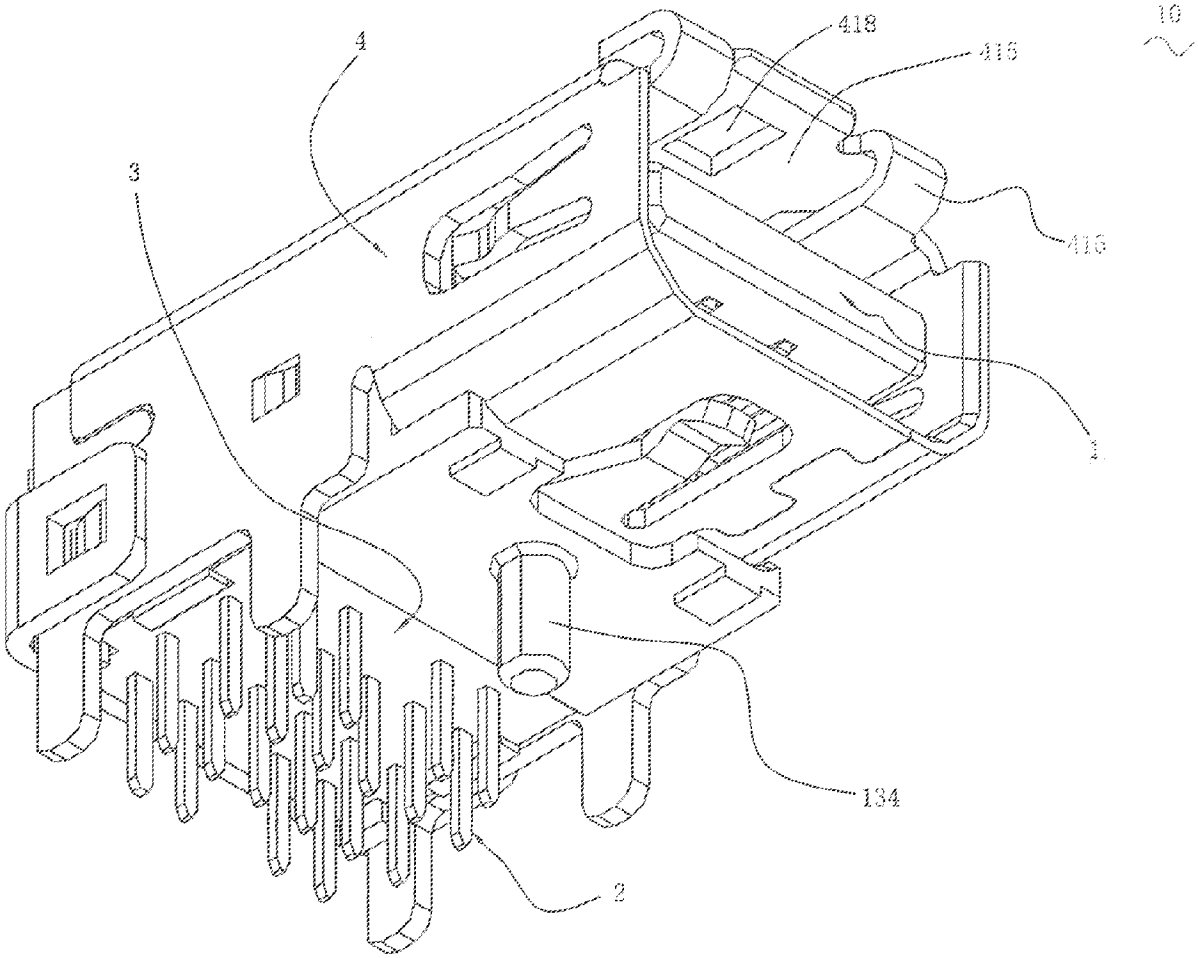
FIG. 1 is a perspective view of an embodiment of a receptacle.
Figure 2:
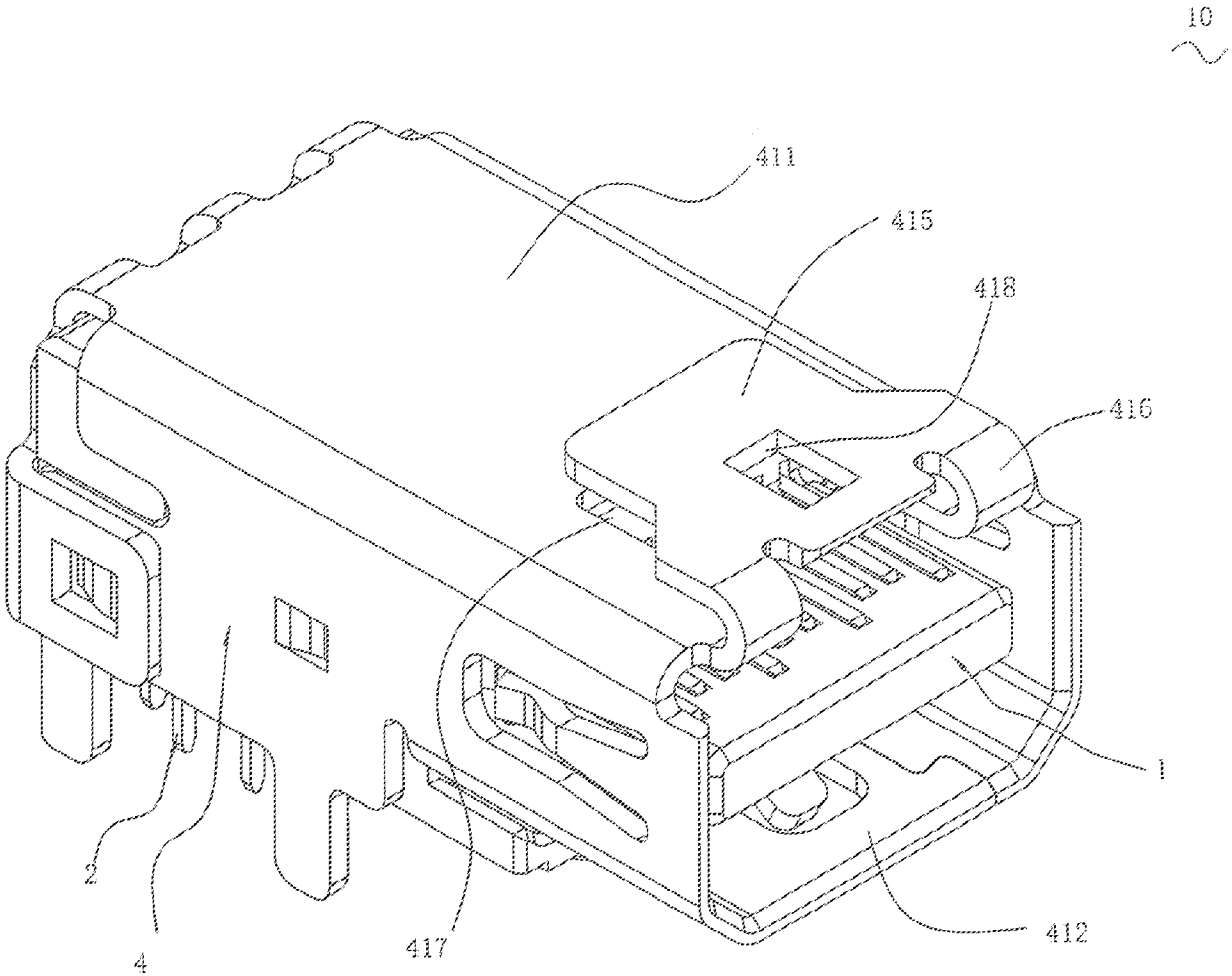
FIG. 2 is another perspective view of the embodiment depicted in FIG. 1.
Figure 3:
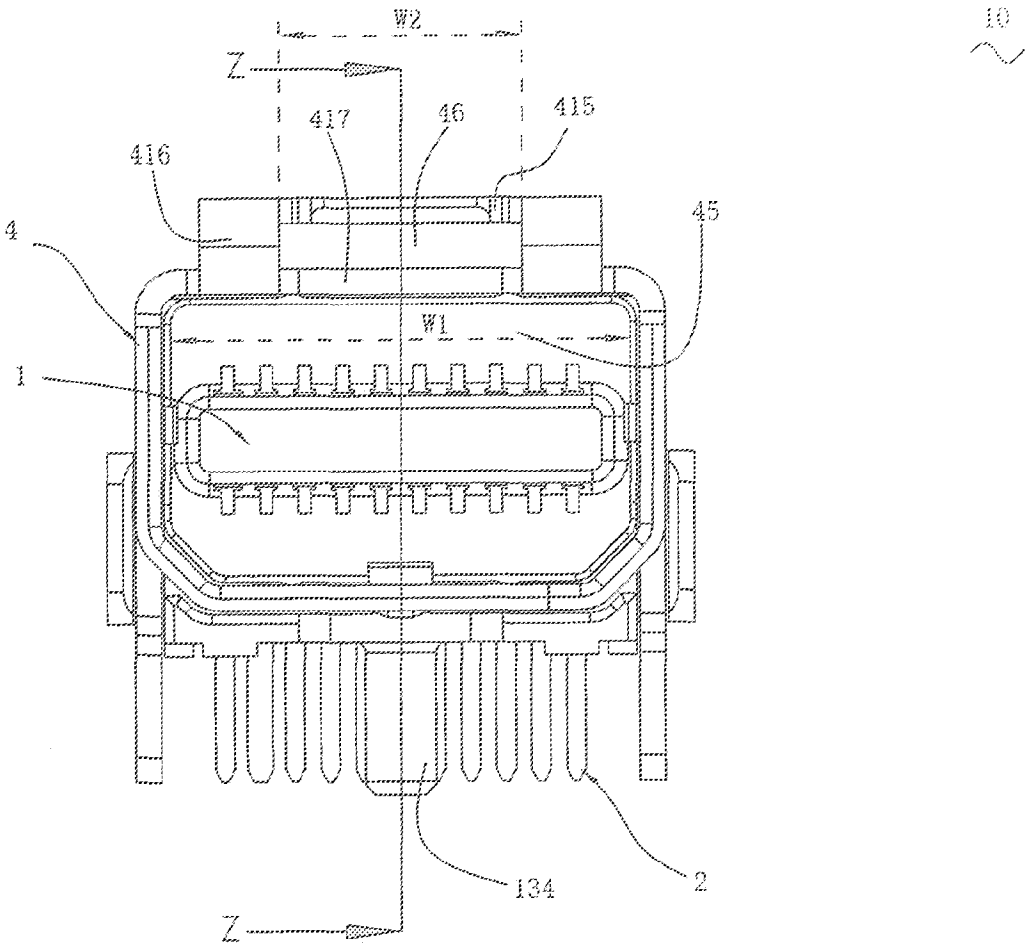
FIG. 3 is a front view of the receptacle shown in FIG. 1.
Figure 4:
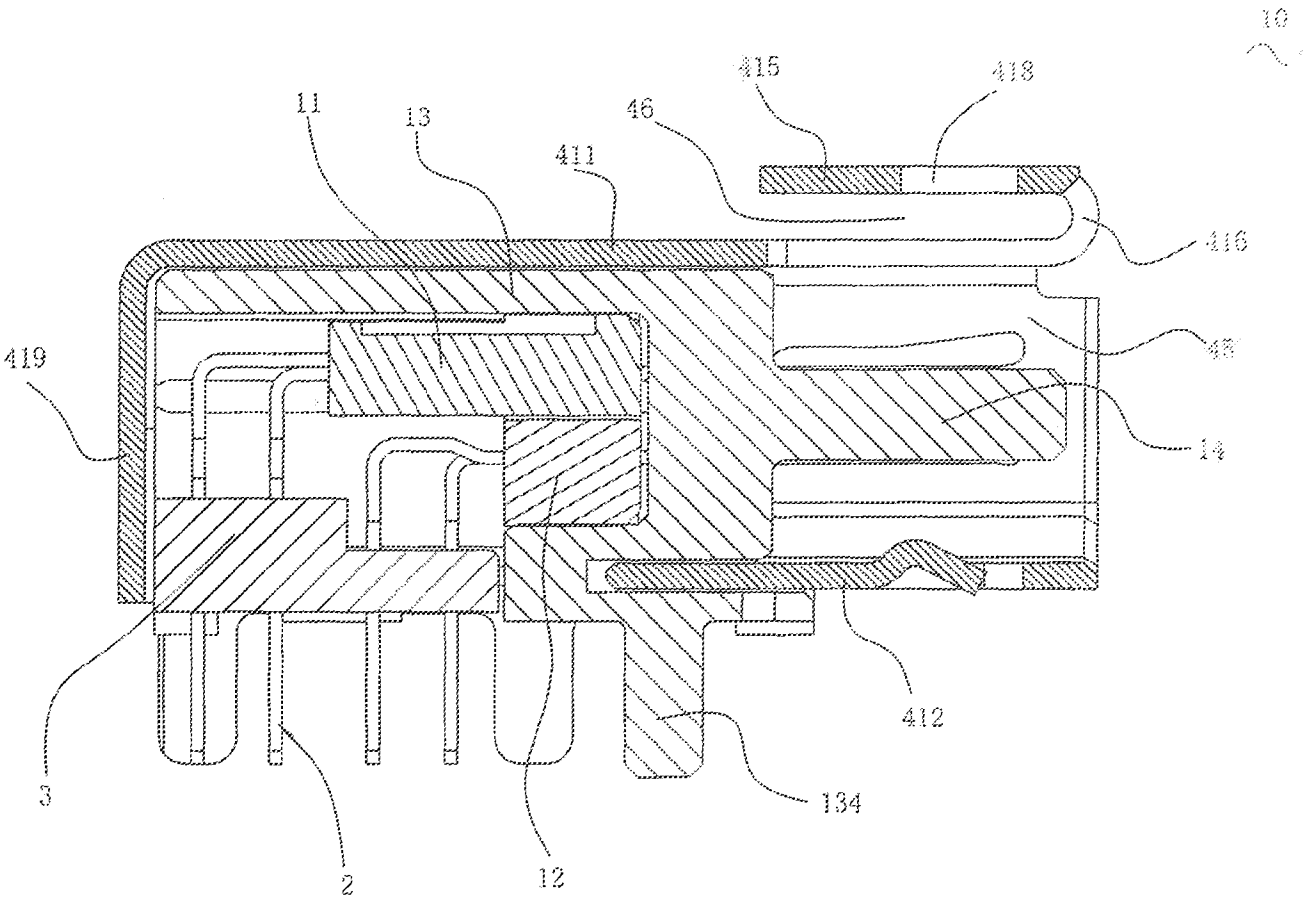
FIG. 4 is a cross-sectional view taken along a line Z-Z of FIG. 3.
Figure 5:
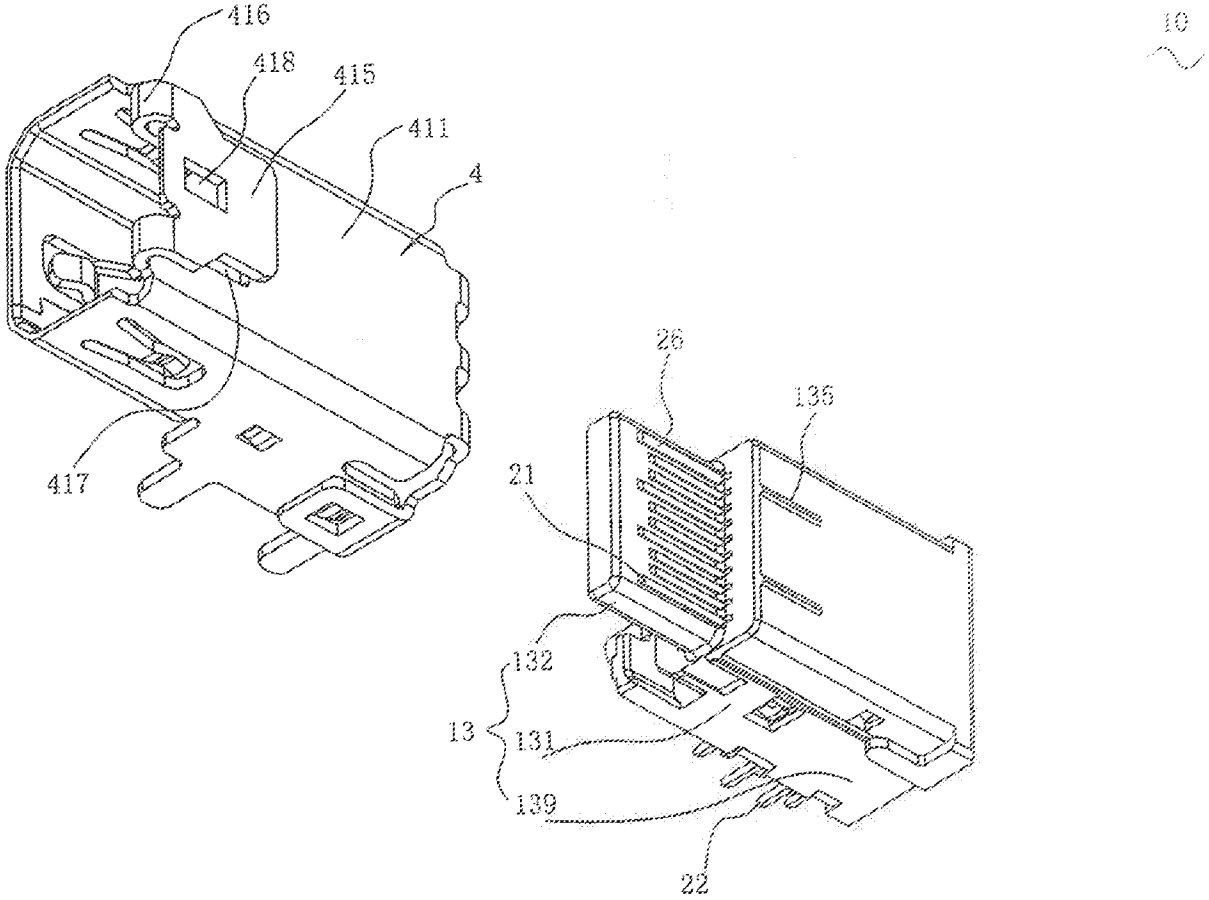
FIG. 5 is an exploded perspective view of the receptacle shown in FIG. 1.
Figure 6:
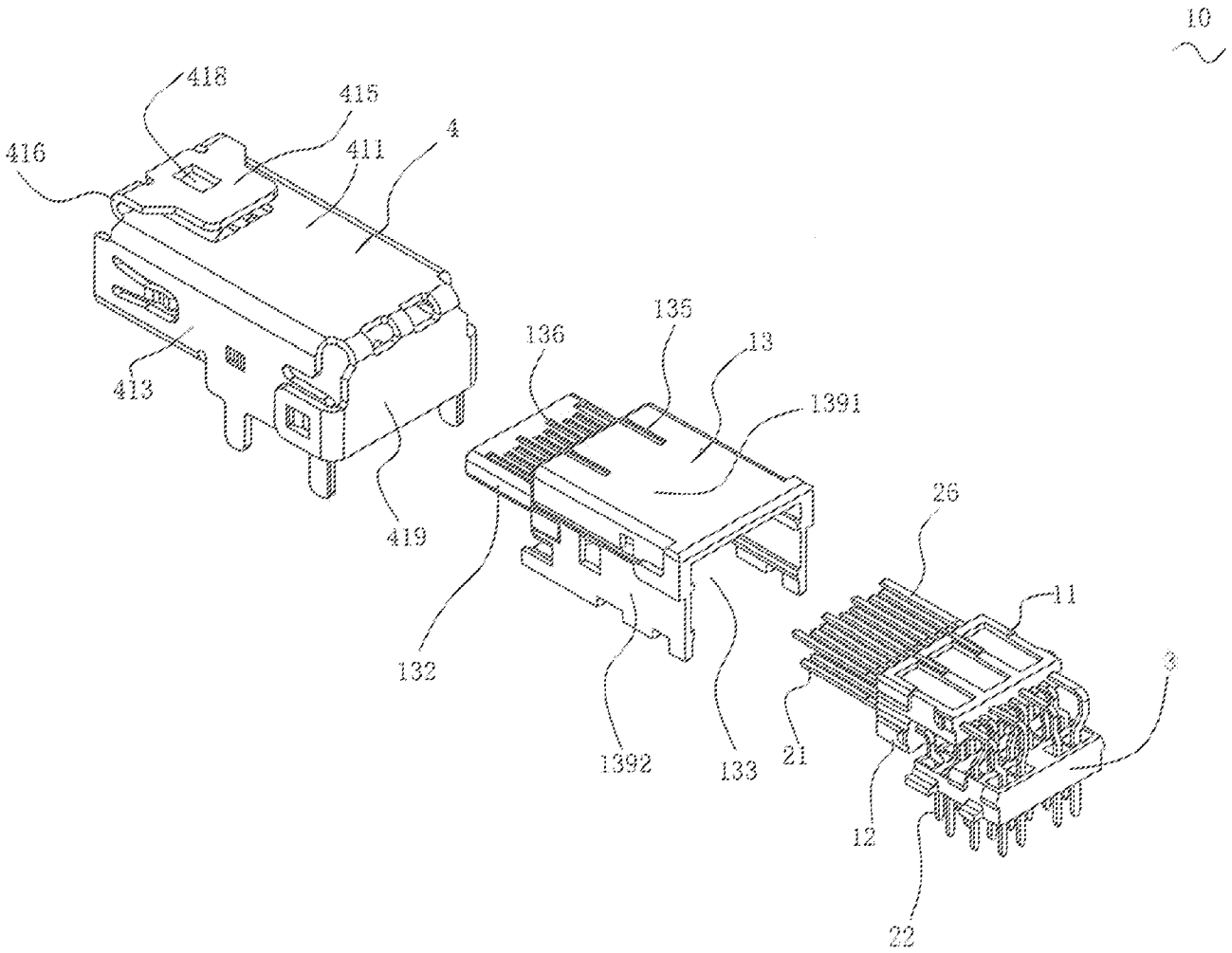
FIG. 6 and FIG. 7 are further perspective views of the receptacle shown in FIG. 1.
Figure 7:
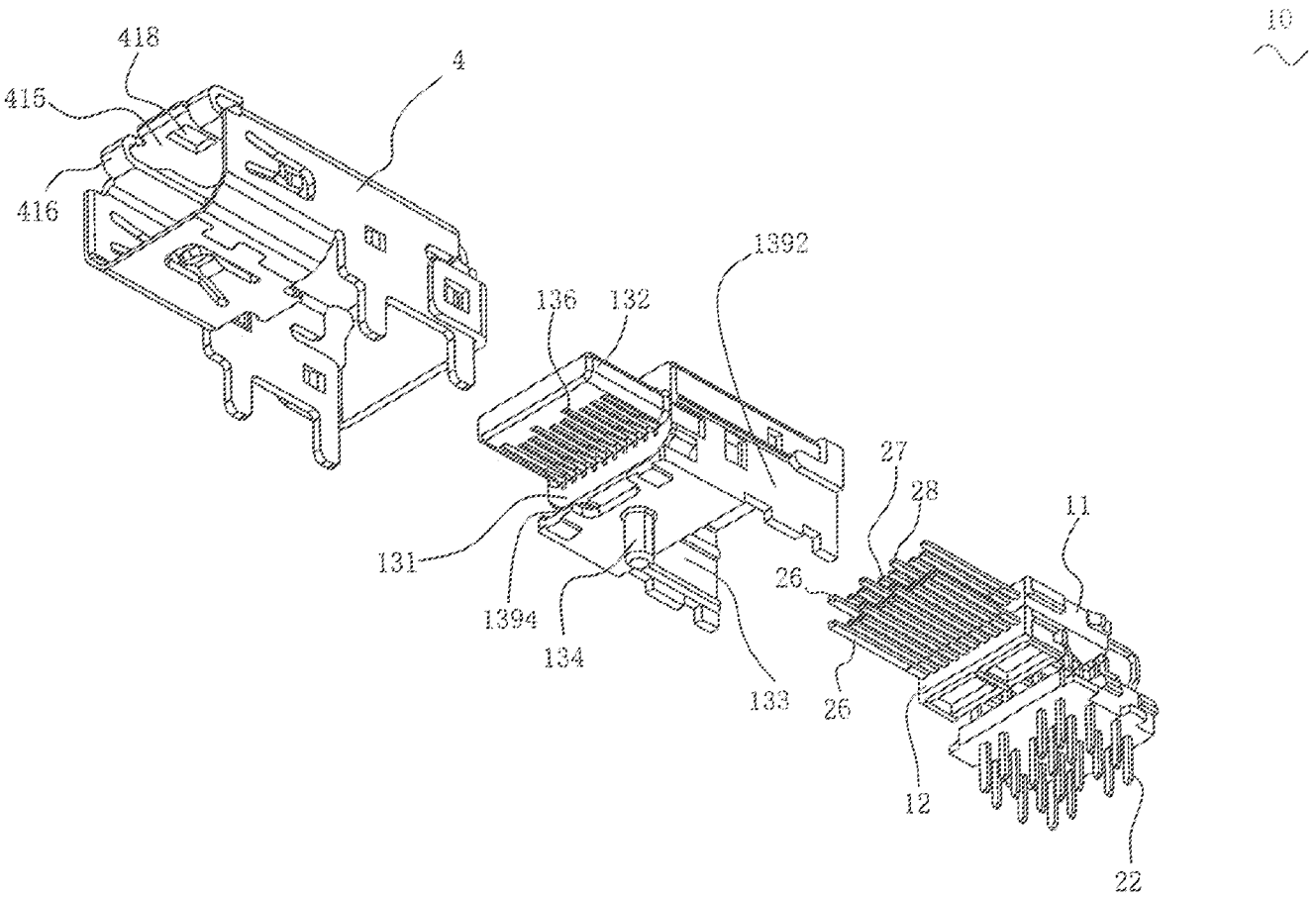

Hereinafter the present disclosure will be further described in details in combination with the Figures. As can be appreciated, the depicted disclosure helps overcome technical problems in the prior art and provides an embodiment of a receptacle which has a strong engagement force to avoid accidental disengagement. Compared with the prior art, in the receptacle of the present disclosure, by that the first cage of the receptacle is provided with a receiving cavity and a locking portion positioned above the receiving cavity; so that the receiving cavity correspondingly receives the protruding portion of the plug when the receptacle is mated with the plug, and the locking portion and the hook are correspondingly latched and locked together, thereby having a strong engagement force to prevent the two electrical connectors from being accidentally disengaged.

Referring to FIGS. 1-4, the present disclosure relates to a receptacle 10 in a style of Mini DisplayPort connector. An embodiment of the receptacle 10 comprises a body 1, formed of an insulative material, a plurality of terminals 2 mounted to the body 1, a positioning piece 3 and a cage 4.

Referring to FIGS. 5-9, the body 1 is formed from an insulating material by inject molding, which comprises a main body 13, and a first module 11 and a second module 12 which are mounted to the main body 13. The main body 13 comprises a base portion 131, a tongue 132 extending forwardly out from a center of the base portion 131, and a frame body portion 139 which extends rearwardly out from the base portion 131 and is opened at a rear end thereof. The base portion 131 and the frame body portion 139 are together enclosed to form an accommodating cavity 133 opening rearwardly, the first module 11 and the second module 12 are stacked vertically and received in the accommodating cavity 133. Specifically, an upper side and a lower side of the tongue 132 are respectively provided with a plurality of terminal grooves 136. The frame body portion 139 comprises a top wall 1391 extending rearwardly out from a top of the base portion 131, two side walls 1392 extending rearwardly out from both sides of the base portion 131, and a bottom wall 1393 extending rearwardly out from a bottom of the base portion 131. A length of the bottom wall 1393 is shorter than that of the top wall 1391. A front part of the top wall 1391 is provided with two protruding bars 135 spaced apart from each other and extending along a front-rear direction. A front end surface of the base portion 131 is formed with a slot 1394 opening forwardly, a positioning post 134 protrudes downwardly from a middle part of the bottom wall 1393, which can strengthen a positional relationship between the connector receptacle 10 and a mounting circuit board (not shown in the Figures).

Figure 8:
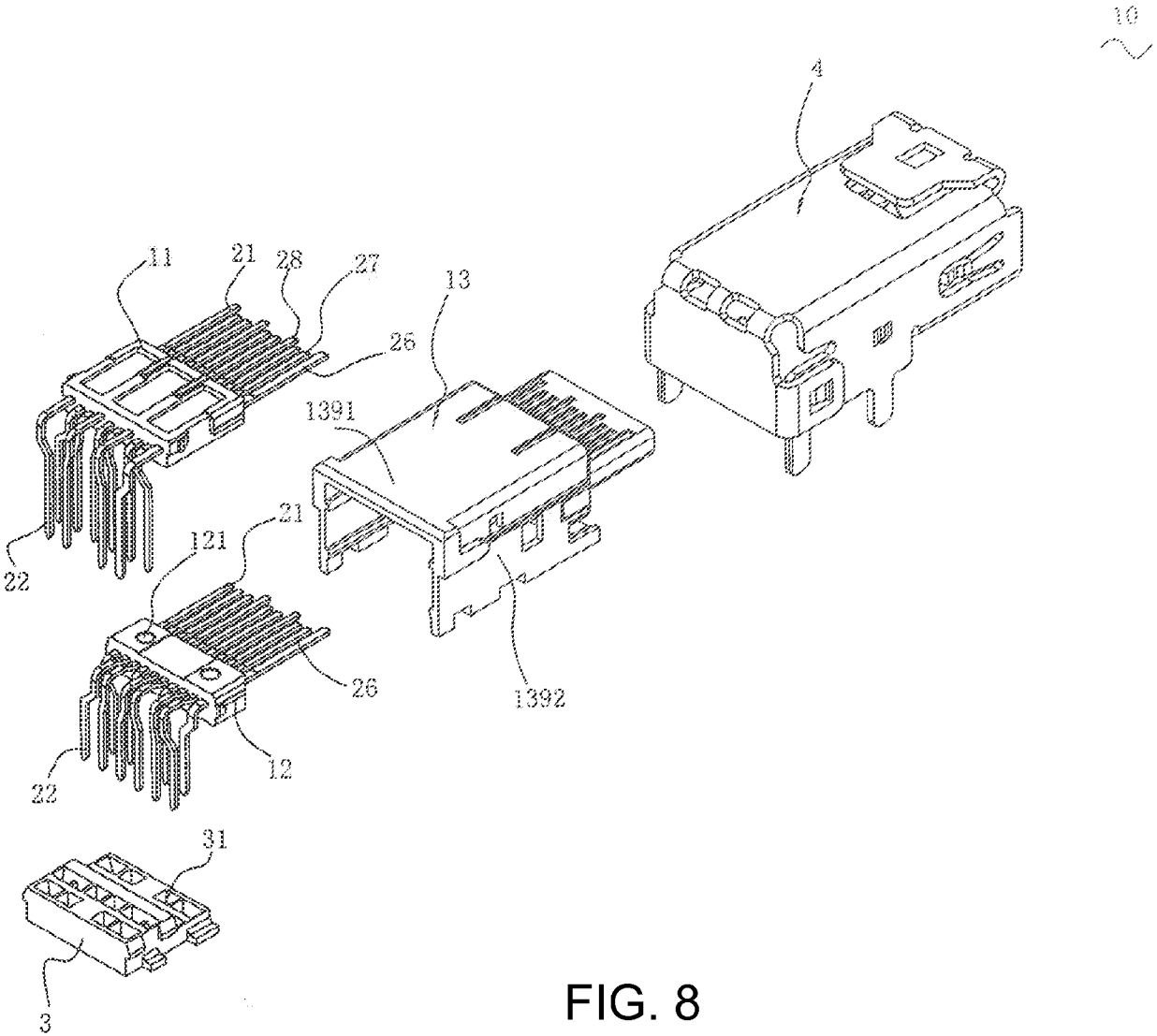
FIG. 8 and FIG. 9 are further perspective views of the receptacle shown in FIG. 1.
Figure 9:
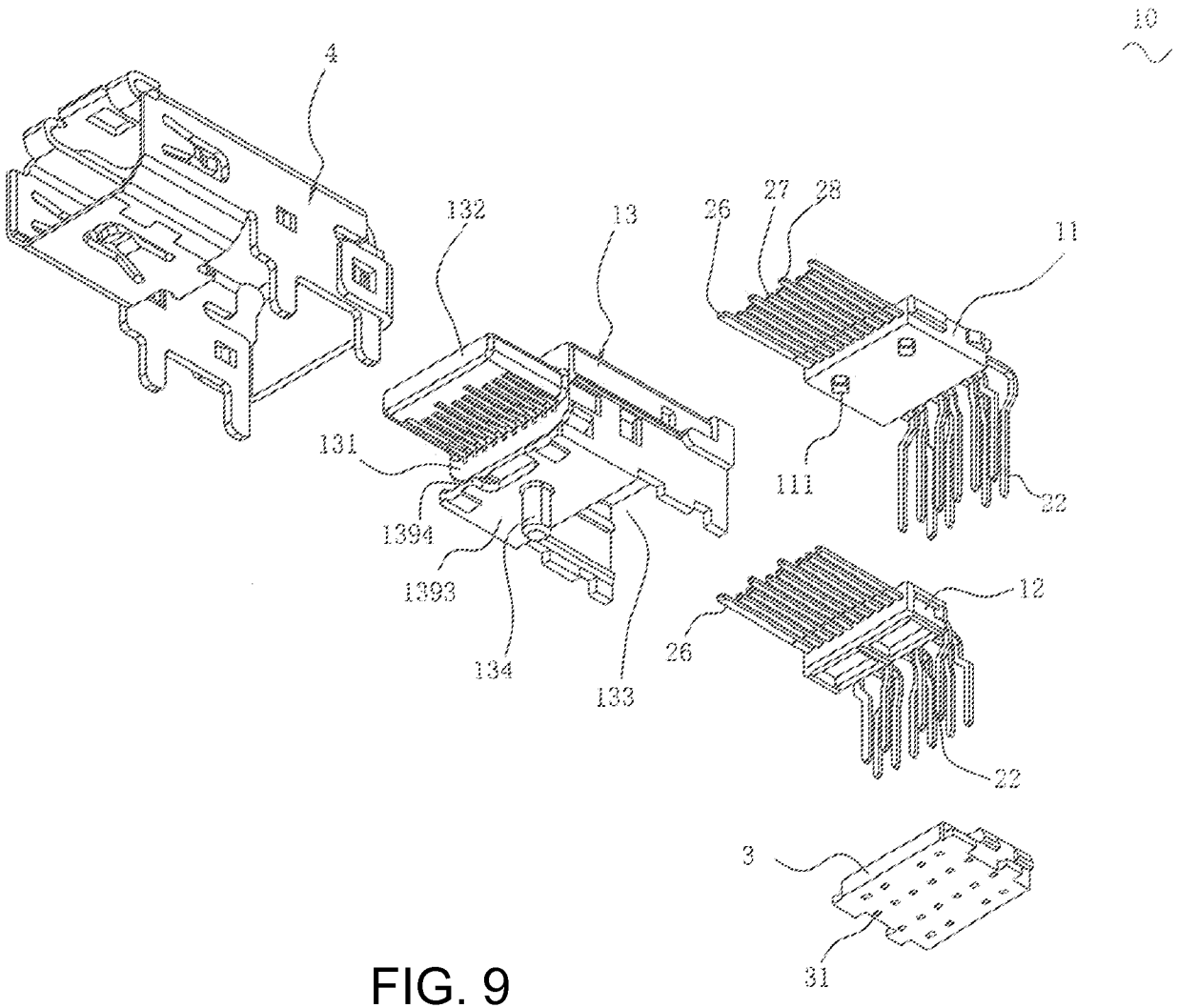

Referring to FIG. 8 and FIG. 9, the first module 11 is formed with two positioning protruding posts 111 protruding downwardly. Two positioning grooves 121 are correspondingly recessed on the second module 12, these two positioning grooves 121 and two positioning protruding posts 111 can be correspondingly engaged together, so that the first module 11 and the second module 12 are aligned and mounted together.

Referring to FIGS. 6-9, these terminals 2 are formed by stamping and bending a metal material, and are fixed to the body 1 by an insert molding process. Each terminal 2 has a mating portion 21 and a soldering portion 22. The mating portions 21 of these terminals 2 are respectively provided at the upper side and the lower side of the tongue 132. In the embodiment, these terminals 2 are respectively embedded into the first module 11 and the second module 12, the mating portions 21 of these terminals 2 are correspondingly inserted into the terminal grooves 136 at the upper side and the lower side of the tongue 132, the mating portions 21 of the terminals 2 embedded into the first module 11 are correspondingly inserted into the terminal grooves 136 at the upper side of the tongue 132, the mating portions 21 of the terminals 2 embedded into the second module 12 are correspondingly inserted into the terminal grooves 136 at the lower side of the tongue 132. The two rows of terminals 2, respectively positioned at the upper side and the lower side of the tongue 132, each comprise a current terminal 26, a plurality of pairs of differential signal terminals 27 and a plurality of ground terminals 28. The mating portions of these two current terminals 26 are provided oppositely up and down respectively at the upper side and the lower side of the tongue 132, and transverse widths of the mating portions of these two current terminals 26 are greater than transverse widths of the mating portions of these differential signal terminals 27. The mating portions of these current terminals 26 can have greater transversal widths and be position on opposite sides of the tongue helps facilitate power transmission.

Referring to FIGS. 6-9, the positioning piece 3 is formed from an insulating material by inject molding, and is mounted behind the second module 12. The positioning piece 3 is provided with a plurality of vias 31 to allow the soldering portions 22 of these terminals 2 to correspondingly pass through. Thus a short circuit due to deformation of the soldering portion 22 of the terminal 2 can be avoided.

Referring to FIGS. 3-7, the cage 4 is formed by stamping and bending a metal material, which surrounds the body 1 and is formed with a mating cavity 45 around the tongue 132 of the body 1 and a receiving cavity 46 positioned above and communicated to the mating cavity 45, and a transverse width W2 of the receiving cavity 46 is smaller than a transverse width W1 of the mating cavity 45. Specifically, the cage 4 comprises a top plate 411, a bottom pate 412, two side plates 413 connected between the top plate 411 and the bottom plate 412 and a rear cover 419 bending downwardly from a rear end of the top plate 411 and extending, the rear cover 419 and the two side plates 413 are latched together. The top plate 411 is provided with a receiving groove 417 which is opened at a front end thereof, the top plate 411 is firstly bent upwardly and then bent rearwardly and extends to form bent portions 416 at front edges of both sides of the receiving groove 417, respectively, the two bent portions 416 further extend rearwardly to form a locking portion 415, the locking portion 415 connects rear ends of the two bent portions 416 together, and the receiving cavity 46 is formed between the locking portion 415 and the top plate 411. The locking portion 415 is correspondingly suspended above the receiving groove 417, a space between the locking portion 415 and the receiving groove 417 is the receiving cavity 46, a transverse width of the receiving groove 417 is the transverse width W2 of the receiving cavity 46. A transverse width of a rear end of the locking portion 415 is substantially the same as the transverse width of the receiving groove 417. A middle part of the locking portion 415 is formed with a latching hole 418 penetrating up and down so as to engage with a hook of a mating plug. A rear end of the bottom plate 412 can be correspondingly inserted into the slot 1394 of the body 1 so as to position the cage 4. The rear cover 419 can cover the accommodating cavity 133 of the body 1 to prevent electromagnetic radiation from leaking, the positioning piece 3 abuts between the rear cover 419 and the bottom wall 1393 of the body 1 in the front-rear direction.

An assembling process of the receptacle 10 of the present disclosure generally includes the following steps: stamping and forming these terminals 2; embedding the first module 11 and the second module 12 at the outer peripheries of these terminals 2; then assembling the first module 11 and the second module 12 together; next inserting the assembly of the first module 11 and the second module 12 forwardly into main body 13; then fixing and mounting the positioning piece 3 to the main body 13 from the down to the up, while allowing the soldering ends 22 of the terminals 2 to correspondingly pass through the plurality of vias 31; subsequently installing the cage 4 rearwardly to the outer periphery of the body 1 from the front of the body 1 (at this time, the rear cover 419 is in an horizontally extending rearwardly state), next bending the rear cover 419 of the cage 4 downwardly, and allowing the rear cover 419 and the two side plates 413 of the cage 4 to latch together.

Figure 10:
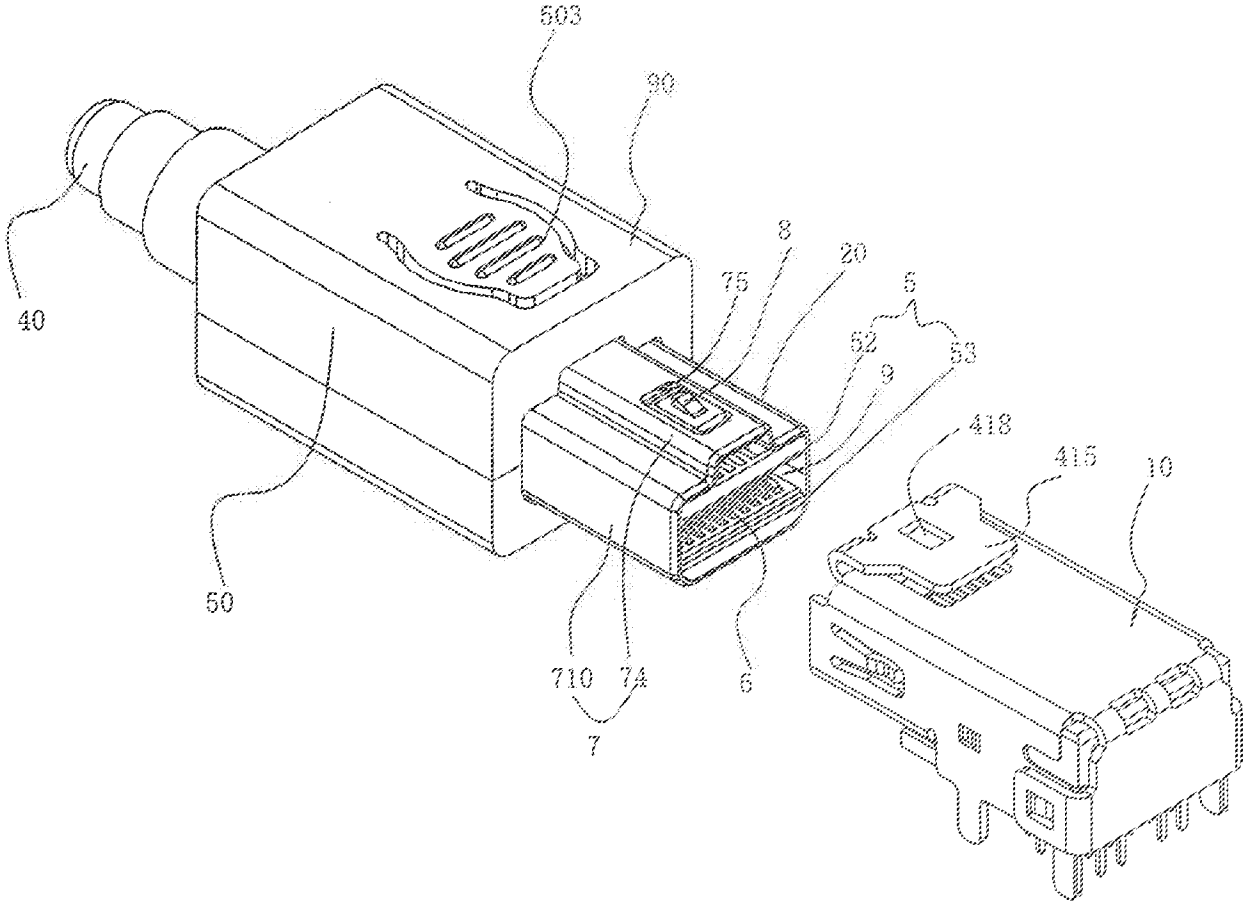
FIG. 10 is a perspective view that the receptacle shown in FIG. 1 is separated from a mating plug.
Figure 11:
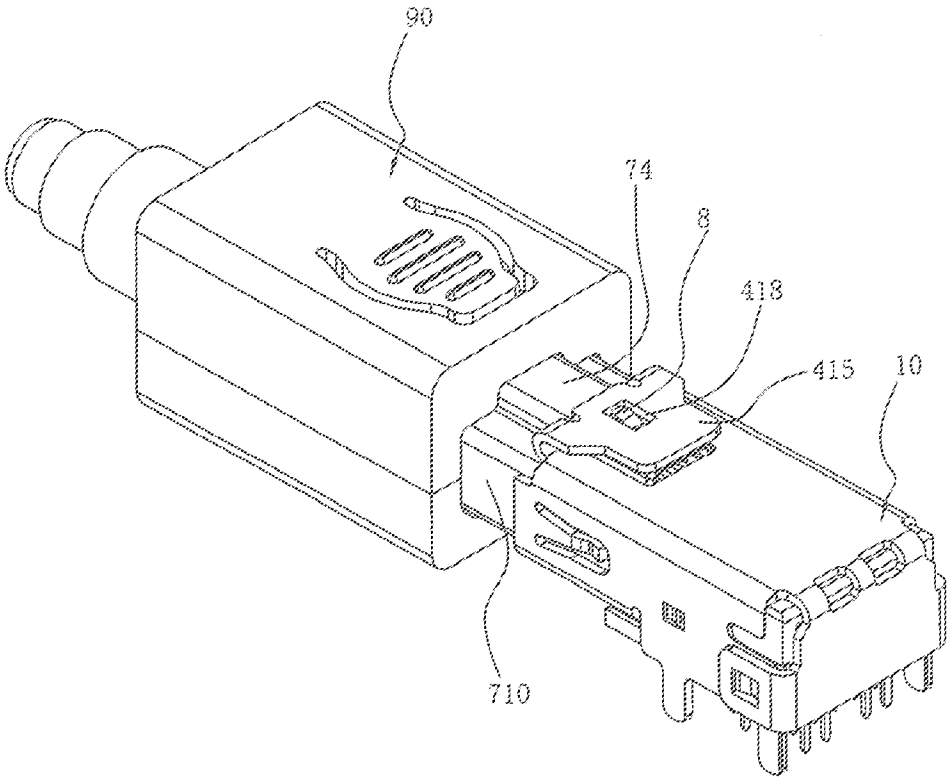
FIG. 11 is a perspective view that the receptacle shown in FIG. 1 is mated with the mating plug.

Referring to FIG. 10 and FIG. 11, the receptacle 10 of the present disclosure can be mated with a plug cable assembly 90. The plug cable assembly 90 comprises a plug 20, a cable 40 electrically connected to the plug 20 and an outer insulative housing 50 surrounding an outer periphery. The plug 20 may comprise a second insulative housing 5, a plurality of second terminals 6 mounted to the second insulative housing 5, a second cage 7 and a hook 8 protruding upwardly from the second cage 7 and capable of moving up and down. The second insulative housing 5 comprises an upper mating plate 52 and a lower mating plate 53. The second cage 7 is formed by stamping and bending a metal material, which is shaped as a convexity which is big at a lower side and small at an upper side. The second cage 7 comprises a main body portion 710 positioned at a lower side and a protruding portion 74 protruding upwardly from the main body portion 710. A top surface of the protruding portion 74 is provided with an opening 75 to allow the hook 8 to extend upwardly out. The second cage 7, and the upper mating plate 52 and the lower mating plate 53 are cooperative and enclosed to form a second mating cavity 9. When the receptacle 10 and the plug cable assembly 90 are engaged together, the protruding portion 74 of the plug 20 can be correspondingly received in the receiving cavity 46 of the receptacle 1, the hook 8 of the plug 20 can engage the latching hole 418 of the receptacle 10 so as to increase the engagement force of the two electrical connectors 10, 20 to avoid accidental disengagement. When it is desirable to unmate the two electrical connectors 10, 20 the unlatching can be accomplished by pressing down a button 503 on the second insulative housing 5. Pressing the button 503 causes the hook 8 to be driven downwardly toward a position where the hook 8 is not limited by the latching hole 418. Then, if a pulling action is performed, the separation of the two electrical connectors 10, 20 can be easily achieved.

Compared with the prior art, the receptacle 10 of the present disclosure has the following beneficial effects: by that the first cage 4 of the receptacle 10 is provided with a receiving cavity 46 and a locking portion 415 positioned above the receiving cavity 46; so that the receiving cavity 46 correspondingly receives the protruding portion 74 of the plug 20 when the receptacle 10 is mated with the plug 20, and the locking portion 415 and the hook 8 are correspondingly latched and locked together, thereby having a strong engagement force to prevent the two electrical connectors 10, 20 from being accidentally disengaged.

The above disclosure only relates to a preferred embodiment of the present disclosure, but does not limit implementation solutions of the present disclosure. According to main concept and spirit of the present disclosure, those skilled in the art may conveniently make various variations or modifications. Therefore, the protective scope of the present disclosure is determined by the scope of the appended claims.

What is claimed is:

1. A receptacle configured to mate with a plug, comprising:

a body which comprises a base portion and a tongue protruding forwardly from the base portion;

a plurality of terminals, each terminal having a mating portion and a soldering portion, the mating portions of these terminals being respectively provided at an upper side and a lower side of the tongue; and a cage which is mounted to an outer periphery of the body, a front end of the cage being formed with a mating cavity provided around the tongue and a receiving cavity positioned above and communicated to the mating cavity, and a transverse width of the receiving cavity being smaller than a transverse width of the mating cavity, the cage at least comprising a top plate, the top plate being provided with a receiving groove which is opened at a front end thereof, the top plate being further bent rearwardly and extending to form two bent portions respectively at front edges of both sides of the receiving groove; the two bent portions further extending rearwardly to form a locking portion, the locking portion configured, in operation, to engage a hook of a mating plug, the receiving cavity being formed between the locking portion and the top plate.

2. The receptacle of claim 1, wherein the locking portion connects rear ends of the two bent portions together and a middle part of the locking portion is formed with a latching hole extending up and down.

3. The receptacle of claim 1, wherein the locking portion is suspended above the receiving groove, the receiving cavity is formed between the locking portion and the receiving groove, a transverse width of the receiving groove is the transverse width of the receiving cavity.

4. The receptacle of claim 1, wherein the cage further comprises a bottom plate and two side plates connected between the top plate and the bottom plate, the top plate, the bottom plate and the two side plates are enclosed to form the mating cavity.

5. The receptacle of claim 1, wherein the cage further comprises a bottom plate, two side plates connected between the top plate and the bottom plate and a rear cover bending downwardly from a rear end of the top plate and extending; a front end surface of the body is formed with a slot, a rear end of the bottom plate can be correspondingly inserted into the slot.

6. The receptacle of claim 1, wherein the body comprises a main body, and a first module and a second module which are mounted on the main body, the main body comprises the base portion and the tongue, the main body further comprises an accommodating cavity provided behind the base portion, the first module and the second module are stacked up-down and received in the accommodating cavity.

7. The receptacle of claim 6, wherein an upper side and a lower side of the tongue are respectively provided with a plurality of terminal grooves; these terminals are respectively embedded into the first module and the second module, the mating portions of these terminals are correspondingly inserted at the upper side and the lower side of the tongue.

8. The receptacle of claim 6, wherein at least one positioning protruding post protrudes from the first module, at least one positioning groove is recessed on the second module, the at least one positioning groove and the at least one positioning protruding post are engaged correspondingly, so that the first module and the second module are aligned and mounted together.

9. The receptacle of claim 6, wherein the main body further comprises a frame body portion extending rearwardly out from the base portion, the frame body portion comprises a top wall extending rearwardly out from a top of the base portion, two side walls extending rearwardly out from both sides of the base portion and a bottom wall extending rearwardly out from a bottom of the base portion, a positioning post protrudes downwardly from the bottom wall.

10. The receptacle of claim 1, wherein these terminals comprise two current terminals and a plurality of differential signal terminals, and the mating portions of these two current terminals are provided oppositely up and down respectively at the upper side and lower side of a tongue wall, and transverse widths of the mating portions of these two current terminals are greater than transverse widths of the mating portions of these differential signal terminals.

* * * * *